US005322385A

United States Patent [19]

Reisman

[11] Patent Number: 5,322,385

[45] Date of Patent: Jun. 21, 1994

[54] ANTI-VEHICLE BARRIER

[76] Inventor: Ron Reisman, 5 Hasatat Street, Jerusalem, Israel

[21] Appl. No.: 976,838

[22] Filed: Nov. 16, 1992

[51] Int. Cl.[5] ..... E01F 13/00

[52] U.S. Cl. ..... 404/6; 256/1

[58] Field of Search ..... 404/6, 15; 256/1

[56] References Cited

U.S. PATENT DOCUMENTS

| | | | |
|---|---|---|---|
| 1,276,100 | 8/1918 | Niznik | 256/1 |
| 3,652,059 | 3/1972 | Groblebe | 356/1 |
| 4,382,714 | 5/1983 | Hutchison | 404/6 |
| 4,995,756 | 2/1991 | Kilsrow et al. | 404/6 |

*Primary Examiner*—William P. Neuder

*Attorney, Agent, or Firm*—Mark M. Friedman

[57] ABSTRACT

An anti-vehicle barrier, which includes a pad made of a compressible material, such as closed cell polyurethane. Distributed throughout the pad is an array of upwardly directed hollow metal spikes for puncturing the tire of a vehicle which rides over the pad. The spikes may be removable so that upon puncturing the tire, they are removed from the pad and are retained by the puncture tire so as to bring about its rapid deflation. When deployed in the pad, the spikes may be flush with or are below the top surface of the pad, and may be connected to each other or directly to the pad, or to both.

18 Claims, 2 Drawing Sheets

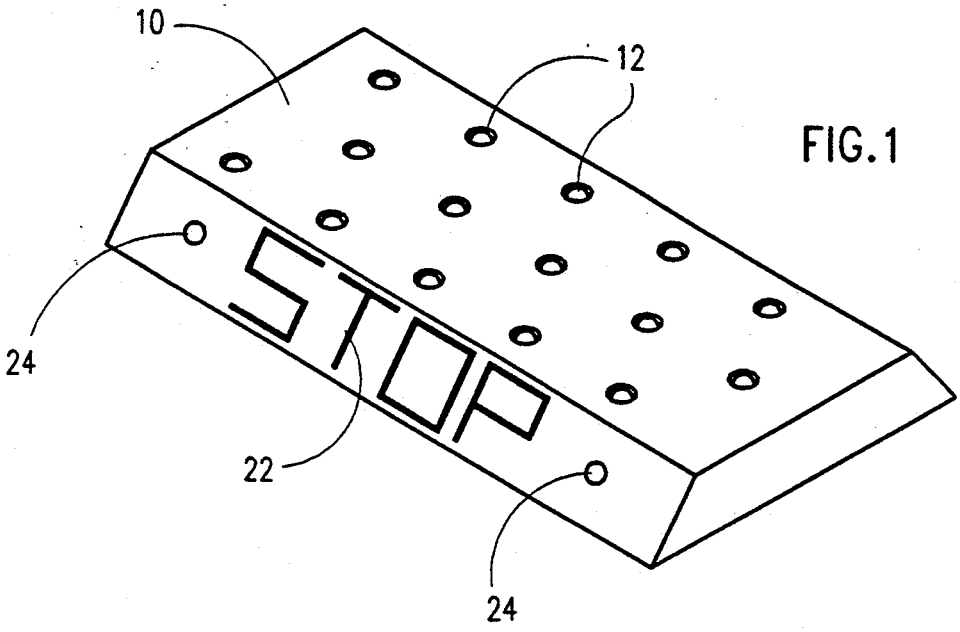
FIG.1
FIG.2
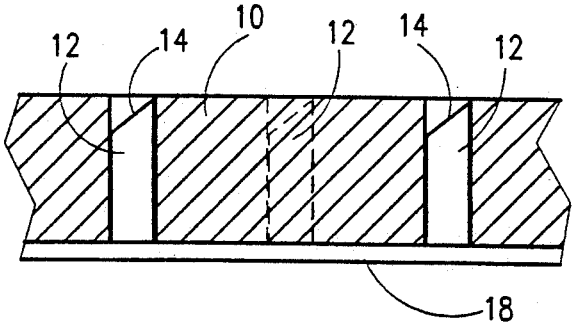
FIG.3
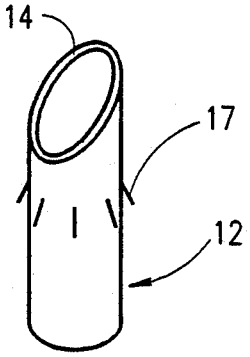
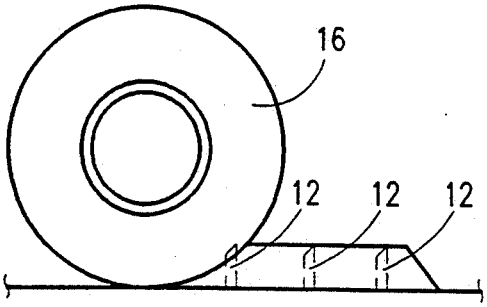
FIG.4
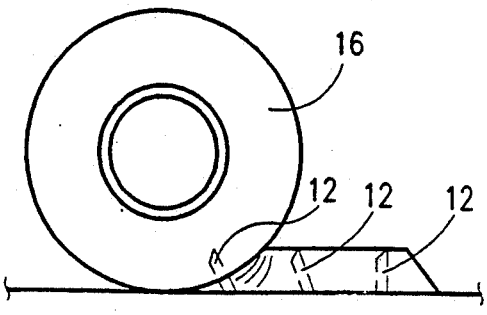
FIG.5

ANTI-VEHICLE BARRIER

FIELD AND BACKGROUND OF THE INVENTION

The present invention relates to anti-vehicle barriers and, more particularly, to displaceable temporary barriers which can be placed on the roadway in order to prevent access by vehicles or to promptly disable any vehicles which attempt to cross the barriers.

It is sometimes desired to block off the passage of vehicles to and/or from certain areas. This can be accomplished by a variety of techniques, including through the erection of permanent obstacles, such as concrete barriers, and the like. However, in certain cases, it is desired to erect obstacles which are temporary in nature and which can be quickly and easily deployed and removed. For example, the police often have need to set up temporary roadblocks to channel and control the flow of traffic so as to better effect the inspection of the vehicles and/or the drivers, or for other purposes.

Such roadblocks may, for example, be set up using a series of appropriately placed barrels or other obstacles. A more sophisticated roadblock may include one or more barriers members, each of which typically consists of a metal frame bearing upwardly-directed metal spikes. The barriers are placed in suitable locations on the roadway and serve to puncture the tires of any vehicle whose driver ignores warnings and directions and drives the vehicle over the barriers.

While such mechanisms are effective, they call for the use of rigid and relatively heavy metal contraptions which are difficult to store, cumbersome and dangerous to deploy and time-consuming to remove. Often, these barriers get damaged when a vehicle is driven over them and therefore need to be replaced.

There is thus a widely recognized need for, and it would be highly advantageous to have, an anti-vehicle barrier, such as might be useful for roadblocks which would effectively puncture the tires of a vehicle driven over it. The barrier would be foldable, or stackable, for easy storage, it would be lightweight and modularized for easy deployment and removal, such deployment would be safe and non-hazardous to the operating personnel, and the barrier would be reusable.

SUMMARY OF THE INVENTION

According to the present invention there is provided an anti-vehicle barrier, comprising: (a) a compressible pad having a top surface and a bottom surface; and (b) a plurality of upwardly directed spikes disposed in the pad for puncturing the tire of a vehicle which rides over the pad.

According to further features in preferred embodiments of the invention described below, the compressible pad is made up of a sponge-like or foamed material, having closed cells, such as rubber or closed cell polyurethane.

According to still further features in the described preferred embodiments the spikes, which are preferably metallic, are hollow and their upper ends are flush with, or somewhat below, the top surface of the compressible pad.

According to yet further features in the described preferred embodiments the spikes, are designed to imbed in, and remain in, the tire of the vehicle driving over the barrier.

The present invention successfully addresses the shortcomings of the presently known configurations by providing an anti-vehicle barrier which is lightweight and which can be readily and safely folded and unfolded for easy storage and deployment.

The present invention discloses a novel anti-vehicle barrier which is preferably made up of a series of connected sponge-like foamed pad segments, which segments may be of any suitable shape or size. Distributed throughout each pad is an array of upwardly-directed spikes. The barrier is made up of a number of segments to facilitate the folding, or stacking, of the barrier when not in use.

To use an anti-vehicle pad according to the present invention the pad is brought to the site and is then quickly and safely unfolded and installed at the appropriate location. When it is desired to remove the barrier, the pad is rolled, folded or stacked and is then transported away from the site.

BRIEF DESCRIPTION OF THE DRAWINGS

The invention is herein described, by way of example only, with reference to the accompanying drawings, wherein:

FIG. 1 is a perspective view of one segment of a vehicle barrier according to the present invention;

FIG. 2 is a side cross-sectional view of a portion of the segment of FIG. 1;

FIG. 3 is a perspective view of a single spike such as might be used in the barrier of FIGS. 1 and 2;

FIG. 4 is a side view of a device according to the present invention as a tire of an approaching vehicle first contacts it;

FIG. 5 is a view as in FIG. 4 showing the puncturing of the tire by a spike as the tire advances onto the barrier;

DESCRIPTION OF THE PREFERRED EMBODIMENTS

Figure 6:
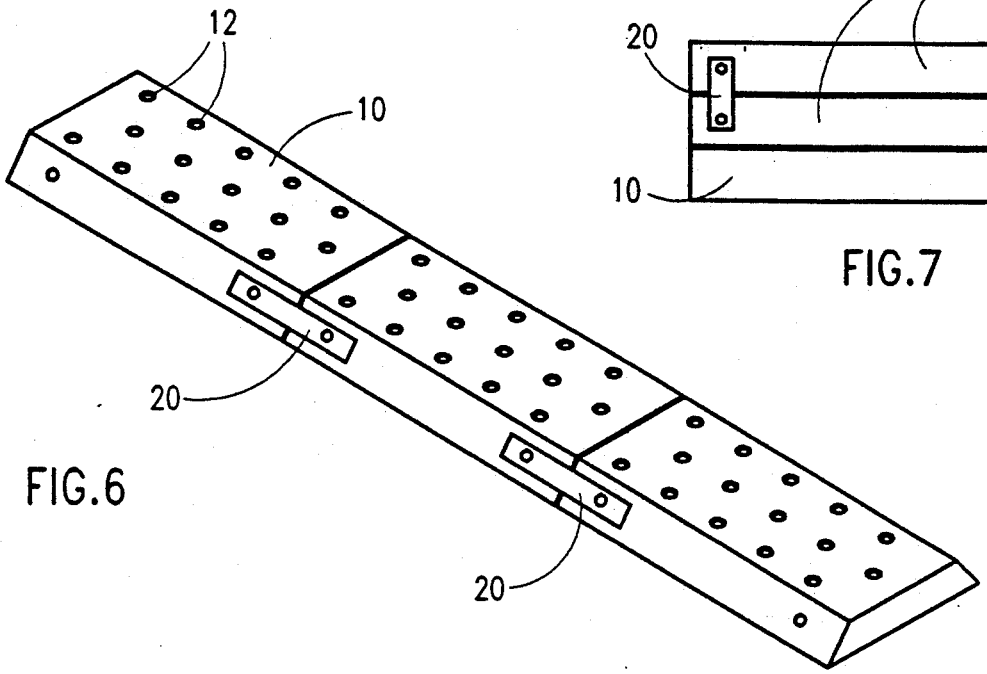
FIG. 6 is a perspective view of a number of linked segments of a barrier as in FIG. 1.

The present invention is of an anti-vehicle barrier which can be quickly, readily and safely deployed and removed. Specifically, the present invention can be used to block off access of vehicles by puncturing the tires of vehicles which are driven over the barrier, thereby rapidly immobilizing them.

The principles and operation of an anti-vehicle barrier according to the present invention may be better understood with reference to the drawings and the accompanying description.

Referring now to the drawing, FIG. 1 illustrates one segment of an anti vehicle barrier according to the present invention. The barrier is made up of a pad 10 which may be of any convenient shape or cross-section. For example, pad 10 may be made of a solid piece of material as shown in the FIGURES, or it may be made of a block which is shaped like an egg-carton so that adjoining pads 10 may nest with adjoining pads 10 when rolled or folded together for storage. Preferably, pad 10 is trapezoidal in cross-section with the bottom surface being wider than the top surface and with one or both of the edges sloping from the bottom surface to the top surface to form one or two ramps. In use, pad 10 is placed on the ground with the bottom surface resting, for example, on the roadway.

Pad 10 can be made up of any suitable material provided that the material is compressible and, preferably, lightweight. Preferably, pad 10 is made up of a foamed or sponge-like material, typically plastic or rubber. Most preferably, the material is closed-cell with the individual pores not being interconnected so as to drastically limit or eliminate the capacity of pad 10 to absorb and retain moisture, such as rainwater. Most preferably, pad 10 is made of foamed closed-cell polyurethane. An additional advantage of such materials, is that deployment of pads made up of such materials is noiseless, in comparison with the deployment of conventional metal barriers currently in widespread use.

Distributed throughout pad 10 in some suitable pattern is an array of spikes 12 which are oriented so that their sharp ends 14 (FIGS. 2, 3) are pointed substantially upwards. Spikes 12 may be of any suitable design and may be made of any suitable material which will allow them to puncture a tire 16 of a vehicle driven over pad 10 (FIGS. 4, 5). Preferably, spikes 12 are made of metal. Preferably, spikes 12 are hollow needle-like tubes with a sharpened end 14 (FIG. 3). The use of hollow spikes facilitates the escape of air from the punctured tire 16 and expedites the immobilization of the vehicle. The use of hollow spikes 12 makes it possible for the barrier to be effective even when tire 16 is of the type which is designed to close around any object puncturing it, such as an ordinary nail.

Figure 8:
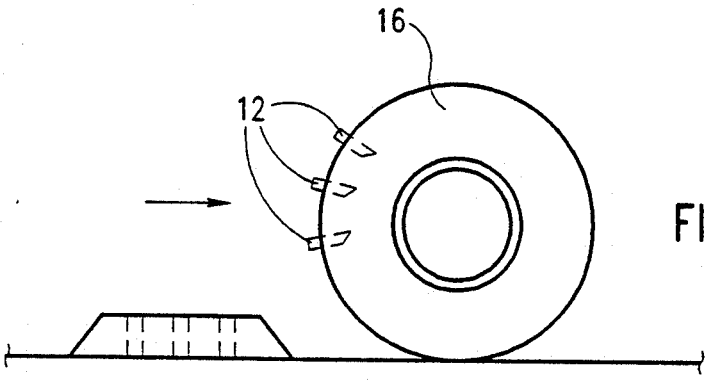
FIG. 8 is a side view of a device according to the present invention as a tire of a vehicle continues to roll after having ridden over the barrier.

Preferably, spikes 12 are such that when a vehicle tire 16 is driven over pad 10, spikes 12 will not only puncture tire 16 but will also firmly embed in tire 16 so that the continued rolling of tire 16 will lift spike 12 and remove it from pad 10 (FIG. 8). In this way, spikes 12, which are preferably hollow, will continue to serve to remove air from tire 16 even after tire 16 has passed the barrier. Spikes 12 removed from pad 10 as described above may be easily replaced by new spikes 12 so as to restore pad 10 to its original status.

To facilitate the firm embedment of spikes 12 in tire 16 it may be desirable to equip the outside surface of spikes 12 with embedment means, for example downward directed protrusions 17 which will not inhibit the penetration of spikes 12 into tire 16 but will considerably hinder the removal of spikes 12 from tire 16 once tire 16 has been punctured. Other embedment means may be envisioned. For example, the diameter of spikes 12 may be varied in such as way as to hinder the relative motion of spike 12 in the direction away from tire 16, or a mechanism may be provided which will come into play upon tire puncture and which will bring about the deployment of suitable projections or other elements serving to prevent the extraction of spike 12 from tire 16.

Any suitable manufacturing process may be used to produce a barrier according to the present invention. For example, spikes 12 may be inserted into pad 10 after pad 10 has already been formed. Preferably, a barrier is made by first arranging spikes 12 in a proper array and then injecting the pad material. When pad 10 sets, a relatively tight bond is established between spikes 12 and pad 10. The presence of protrusions 17 helps with the bonding. Alternatively, it may be desirable to first coat spikes 12 with appropriate adhesive or anti-adhesive materials so as to effect the proper level of bonding between spikes 12 and pad 10.

Preferably, spikes 12 are spaced from each other and may be connected to each other through some suitable array connector 18 which may take the form of a sheet of plastic to which each spike 12 is connected and which is, in turn, attached to pad 10, preferably at the bottom of pad 10, for example, by use of a suitable adhesive. Alternatively, spikes 12 may be completely independent of each other, expect for being mounted in pad 10.

Figure 9:
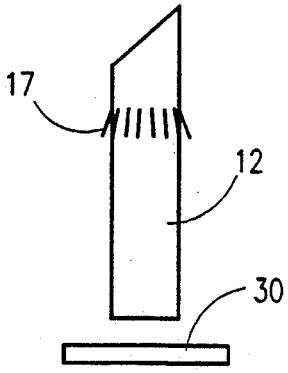
FIG. 9 a side view of a single spike such as that of FIG. 3, also showing a base support member.
Figure 10:
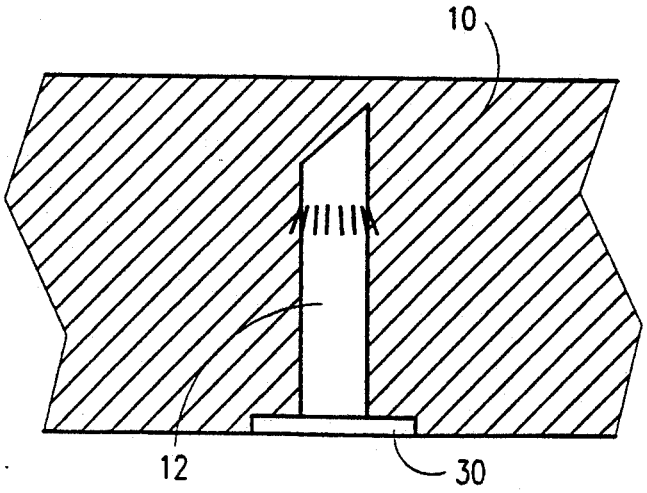
FIG. 10 is a side cross-sectional view of a portion of the pad showing the placement of a single spike and its corresponding base support member.

It may be desirable to further include a base support member 30 beneath each spike 12 (FIGS. 9, 10). Base support member 30 is preferably made of a rigid material such as plastic or metal, preferably a disk with a diameter significantly larger than that of spike 12. Base support members 30 may be particularly important when the barrier is deployed on surfaces which may be relatively soft. In the absence of base support members 30, the forces exerted by tire 16 on spike 12 may be such that the lower portion of spike 12 ma penetrate the ground below rather than puncturing tire 16. To eliminate this possibility, it is preferable to include base support members 30. Each base support member 30 is not rigidly attached to the corresponding spike 12 but is located directly below it. Whenever tire 16 exerts downward forces on spike 12, base support member 30 serves to distribute the forces over a larger area, thereby reducing the pressure (force per unit area) on the ground below and preventing the penetration of the lower portion of spike 12 into the ground, forcing spike 12 to penetrate tire 16. Once tire 16 has been penetrated, spike 12 preferably remains embedded in tire 16, is lifted up and is removed from pad 10 by tire 16 and then serves to allow air to escape from tire 16 thereby rapidly disabling the vehicle.

Preferably, spikes 12 are disposed in pad 10 in such a way that the tips of sharp ends 14 of spikes 12 are flush with, or are just below, the top surface of pad 10. This is preferable for a number of reasons.

First, the top surface of pad 10 shields spikes 12 during deployment and storage so as to minimize or eliminate the chance of injury to the operators and to nearby property, including injury to adjoining pad segments.

Second, the material of construction of pad 10 may be chosen so that pad 10 has sufficient stiffness to support relatively small weights, such as the weight of a person, without yielding, thereby avoiding injury to persons who might walk on the barrier. At the same time, the significantly greater weight of a vehicle would tend to compress pad 10, thereby exposing spikes 12 and enabling them to puncture vehicle tires 16.

In operation, whenever a tire 16 is driven over pad 10 (see FIGS. 4 and 5), pad 10 is compressed. At the same time, the top portion of pad 10 tends to be pulled toward the approaching tire 16. The compression of pad 10 serves to expose spikes 12, while the pulling of the top portion of pad 10 tends to reorient spikes 12 toward tire 16 which improves the puncturing effectiveness of spikes 12. Once tire 16 has been punctured, air can escape through the hollow spikes 12 and the vehicle is quickly immobilized.

Figure 7:
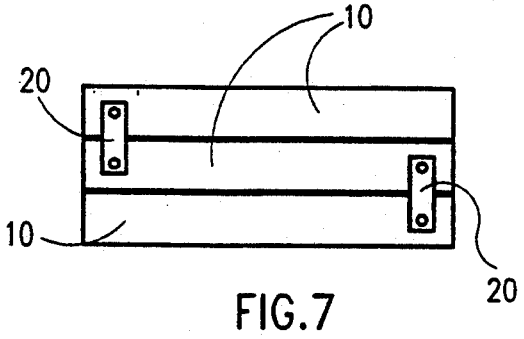
FIG. 7 is a side view of a number of segments as in FIG. 6 stacked for storage.

A barrier according to the present invention may be made up of a number of relatively small segments, of any suitable size or shape, in order to facilitate storage and deployment. One example of this is shown in FIGS. 6 and 7, which shows three segments of pad 10. Each adjoining pair of pads 10 is connected together by some suitable connectors 20 which allows pads 10 to be folded or stacked when not in use (FIG. 7).

Preferably, pad 10 further includes warning indicators to approaching driver to encourage them to avoid driving over the barrier. These warning may take various forms. For example, pads 10 may feature a printed warning message 22, which may include fluorescent and similar markings, which are preferably reflective surfaces and/or flashing or warning lights and/or reflectors 24, as shown in FIG. 1. Pads 10 may, instead or in addition, feature various other messages, including, but not limited to, advertising and other messages.

While the invention has been described with respect to one preferred embodiment, it will be appreciated that many variations, modifications and other applications of the invention may be made.

What is claimed is:

1. An anti-vehicle barrier, comprising:

(a) a compressible pad having a top surface and a bottom surface; and (b) a plurality of upwardly directed spikes disposed in said pad for puncturing a tire of a vehicle which rides over said pad, wherein the upper ends of said spikes are flush with or below said top surface of said compressible pad.

2. An anti-vehicle barrier as in claim 1 wherein said compressible pad is made of a sponge-like material.

3. An anti-vehicle barrier as in claim 1 wherein said compressible pad is made up of a foamed material.

4. An anti-vehicle barrier as in claim 1 wherein said compressible pad is made up of a closed cell material.

5. An anti-vehicle barrier as in claim 1 wherein said compressible pad is made up of closed cell polyurethane.

6. An anti-vehicle barrier as in claim 1 wherein said compressible pad is made up of rubber.

7. An anti-vehicle barrier as in claim 1 wherein said compressible pad is trapezoidal in cross-section with said bottom surface being wider than said top surface.

8. An anti-vehicle barrier as in claim 1 wherein said spikes are made of metal.

9. An anti-vehicle barrier as in claim 1 wherein said spikes are retained by the tire following puncture.

10. An anti-vehicle barrier as in claim 1 wherein said spikes include embedment means.

11. An anti-vehicle barrier as in claim 1 wherein said spikes are connected to each other through an array connector.

12. An anti-vehicle barrier as in claim 11 wherein said array connector is attached to said compressible pad through an adhesive.

13. An anti-vehicle barrier as in claim 1 wherein said spikes are attached to said compressible pad using an adhesive.

14. An anti-vehicle barrier as in claim 1 wherein said spikes are hollow.

15. An anti-vehicle barrier as in claim 1 wherein said pad is made up of a plurality of foldable segments.

16. An anti-vehicle barrier as in claim 1 wherein said pad further includes reflective markings.

17. An anti-vehicle barrier as in claim 1 wherein said pad further includes a printed message.

18. An anti-vehicle barrier as in claim 1 wherein said pad further includes one or more warning lights.

* * * * *